US005091076A

United States Patent [19]

So et al.

[11] Patent Number: 5,091,076

[45] Date of Patent: Feb. 25, 1992

[54] ACID TREATMENT OF KEROGEN-AGGLOMERATED OIL SHALE

[75] Inventors: Bernard Y. C. So, Wheaton; Terry L. Marker, Lisle; Gene E. Tampa, Wheaton, all of Ill.

[73] Assignee: Amoco Corporation, Chicago, Ill.

[21] Appl. No.: 434,916

[22] Filed: Nov. 9, 1989

[51] Int. Cl.[5] ..... C10G 1/00

[52] U.S. Cl. ..... 208/426; 208/424; 208/434; 208/435

[58] Field of Search ..... 208/424, 426, 434, 435

[56] References Cited

U.S. PATENT DOCUMENTS

| | | | |
|---|---|---|---|
| 1,327,572 | 1/1920 | Ryan | 208/434 |
| 1,687,763 | 10/1928 | Hampton | 208/434 |
| 3,184,401 | 5/1965 | Gorin | 208/424 |
| 3,208,930 | 9/1965 | Andrassy | 208/424 |
| 3,816,305 | 6/1974 | Schutte | 208/424 |
| 4,057,486 | 11/1977 | Meadus | 208/434 |
| 4,067,796 | 1/1978 | Alford et al. | 208/424 |
| 4,075,080 | 2/1978 | Gorin | 208/424 |
| 4,133,742 | 1/1979 | Hill | 208/426 |
| 4,138,224 | 2/1979 | Gorin | 208/424 |
| 4,158,638 | 6/1979 | Tsui | 208/426 |
| 4,374,023 | 2/1983 | Davis | 208/435 |
| 4,576,708 | 3/1986 | Oko et al. | 208/426 |
| 4,648,962 | 3/1987 | Capes et al. | 208/426 |
| 4,668,380 | 5/1987 | Wolff et al. | 208/435 |
| 4,673,133 | 6/1987 | Datta et al. | 241/19 |
| 4,737,267 | 4/1988 | Pao et al. | 208/424 |
| 4,804,390 | 2/1989 | Lloyd et al. | 208/390 |
| 4,888,108 | 12/1989 | Farnand | 208/424 |

*Primary Examiner*—Helane E. Myers

*Attorney, Agent, or Firm*—Reginald Taylor; William H. Magidson; Ralph C. Medhurst

[57] ABSTRACT

A kerogen-agglomerated oil shale is contacted with an acid-containing solution prior to economically upgrade the oil shale prior to retorting. The kerogen is agglomerated by contacting the oil shale with a two phase mixture of an organic liquid and water to form kerogen-rich agglomerates and mineral-rich particles. Acids suitable for use in this invention include any acid capable of forming a soluble metallic salt, preferably sulfurous acid.

42 Claims, No Drawings

ACID TREATMENT OF KEROGEN-AGGLOMERATED OIL SHALE

FIELD OF THE INVENTION

The present invention is a method of upgrading beneficiated oil shale to reduce kerogen processing costs. More specifically, the present invention contacts kerogen-agglomerated oil shale with an acid-containing solution to remove carbonates, thereby upgrading the kerogen-agglomerated oil shale.

BACKGROUND OF THE INVENTION

In view of the recent instability of the price of crude oil and natural gas, there has been renewed interest in alternate sources of energy and hydrocarbons. Much of this interest has been centered on recovering hydrocarbons from solid hydrocarbon material such as oil shale, coal, and tar sands by pyrolysis or upon gasification to convert the solid hydrocarbon-containing material into more readily usable gaseous and liquid hydrocarbons.

Vast reserves of hydrocarbons in the form of oil shales exist throughout the United States. The Green River formation of Colorado, Utah, and Wyoming is a particularly rich deposit and includes an area in excess of 16,000 square miles. It has been estimated that an equivalent of 7 trillion barrels of oil are contained in oil shale deposits in the United States, almost sixty percent located in the Green River oil shale deposits. The remainder is largely contained in the leaner Devonian-Mississippi black shale deposits which underlie most of the eastern part of the United States.

Oil shales are sedimentary inorganic materials that contain appreciable organic material in the form of high molecular weight polymers. The inorganic part of the oil shale is marlstone-type sedimentary rock. Most of the organic material is present as kerogen, a solid, high molecular weight, three-dimensional polymer which has limited solubility in ordinary solvents, and therefore cannot be readily recovered by simple extraction.

A typical Green River oil shale is comprised of approximately 85 percent mineral components, of which carbonates are the predominate species, and lesser amounts of feldspars, quartz, and clays are also present. The kerogen component represents essentially all of the organic material. A typical elemental analysis of Green River oil shale kerogen is approximately 78 weight percent carbon, 10 weight percent hydrogen, 2 weight percent nitrogen, 1 weight percent sulfur, and 9 weight percent oxygen.

Most of the methods for recovering kerogen from oil shale involves mining the oil shale, crushing it, and thermally decomposing (retorting) the crushed oil shale. In view of the fact that approximately 85 weight percent of the oil shale is mineral components, unless something is done to remove these minerals, most of the material which is fed, heated up, and circulated in a retort cannot produce oil. This high percentage of inorganic material significantly interferes with subsequent shale processing to recover the kerogen. For example, in retorting oil shale, either large or numerous retorts are needed to process the commercial quantities involved. Moreover, a substantial amount of heat is expended and lost in heating up the inorganic minerals to retorting temperatures and cooling them back down again.

Another problem associated with the presence of large amount of inorganic mineral matter in the oil shale is pollution. In the retorting process, contaminating fines are produced, and therefore must be disposed of. The greater the quantity of minerals, the greater the quantity of fines. Another source of pollution is the spent shale recovered from the retort. During retorting, chemical reactions occur in the shale as the kerogen is volatilized. This results in a residue of chemical compounds in the spent shale leaving the retort. These compounds can present a hazard in surface water pollution after they have been discarded.

As a result of problems associated with the high percentage of minerals in oil shale, it can be economically beneficial to reject the minerals prior to retorting. The process of rejecting these minerals and concentrating the kerogen prior to retorting is called "shale beneficiation." This beneficiation is basically divided into two steps. The first step is liberating the kerogen from the mineral matter. The second step is separating the kerogen from the mineral matter.

An essential part of liberating the kerogen from the mineral matter is comminuting the shale. There are many options for comminuting the shale. Hazemag mills, semiautogenous (SAG) mills, ball mills, and tower mills can be effective for various stages of comminuting. The number of comminution stages and the selection of the most efficient mill depends upon the intrinsic grain size of the kerogen and the extent of kerogen liberation required.

In a SAG mill, which is a cascade mill in which about 10 volume percent steel balls supplement the oil shale solid feed as comminution media, the shale can be comminuted down to about ½ in. top size. A ball mill, which is a tumbling mill using about 50 volume percent steel balls as comminution media, can comminute the shale down to about 0.003 in. top size. To obtain a top size of less than 0.003 in., a tower mill can be used. A tower mill is a stirred ball mill that uses attrition as the mechanism for size reduction.

After comminuting the shale to produce kerogen-rich particles and mineral-rich particles, the second step of beneficiation is separating these particles from each other. The two basic types of kerogen-rich/mineral-rich particle separation are chemical and physical separation.

Chemical separation includes leaching of minerals, such as acid leaching of carbonates, or extraction of kerogen by chemically breaking the kerogen bonds. U.S. Pat. Nos. 4,176,042 and 4,668,380 disclose examples of chemical beneficiation of oil shales.

One type of physical separation is density separation. Density separation is possible because kerogen has a specific gravity of about 1 gm/cm$^3$ and because min eral components in shale have a density of about 2.8 gm/cm$^3$. Heavy media cyclone is a process for separating by density relatively coarse oil shale particles. An example of a heavy media separation method is disclosed in U.S. Pat. No. 4,528,090. In general, the aim of heavy media separation is to separate oil shale into a kerogen rich fraction having low density and a kerogen-lean fraction having high density. The liquid medium used is a mixture of water and finely ground magnetite and ferrosilicon. By varying the concentration of the magnetite and ferrosilicon, the medium can be made to have a density from 1.8 to 2.4 gm/cm$^3$ so that the shale can be split at the density required. The kerogen-rich material floats and is taken overhead and the kerogen-lean material goes into the underflow from the cyclone.

The disadvantages of this process are that it relies upon an inherent natural heterogeneity among oil shale particles and it has not been successful in separating small particles.

Another type of physical separation is surface property separation. An example of surface property separation is froth flotation. In this process, oil shale particles are mixed with an aerated aqueous solution. Since the kerogen-rich particles have greater hydrophobic character than mineral-rich particles, the kerogen-rich particles preferably adsorb onto air bubbles, thereby causing the kerogen-rich particles to float. Subsequently, the froth containing these kerogen-rich particles is removed. Additives can be used to improve kerogen grade and recovery. One disadvantage of the froth flotation process is the oil shale particles are required to be comminuted to a fine particle size prior to froth flotation. Another disadvantage of froth flotation is that the effects of different types of collectors, frothers, and dispersants are difficult to predict. In addition, floated, kerogen-enriched shale has a tendency to have a higher concentration of carbonates than starting shale. An example of a froth flotation process is disclosed in U.S. Pat. No. 4,673,133.

Another example of surface property separation is kerogen agglomeration. Kerogen agglomeration is a process whereby shale is comminuted or kneaded in the presence of an organic liquid and water to form large agglomerates of the kerogen-rich particles, while small mineral-rich particles disperse into the water phase.

In Reisberg, J., "Beneficiation of Green River Shale by Pelletization," *American Chemical Society* (ASCMC8), V. 163 (Oil Shale, Tar Sands, and Related Materials), pp. 165–166, 1981, ISSN 00976156, a form of kerogen agglomeration of shale is disclosed. This reference describes precomminuting the oil shale to a size small enough to pass through a 0.0059 in. (100 mesh) screen. This shale is subsequently comminuted in the presence of heptane and water to form a kerogen-enriched fraction in the form of discrete flakes or pellets and mineral-rich particles dispersed in an aqueous phase. These pellets are then separated from the aqueous phase using sieves. The major disadvantage of the process disclosed by this reference is the comminution cost associated with the initial comminution of the shale is prohibitively high and requires an excessive power outlay. An estimated total comminution power input for this process is 130 Kw-hr/ton of shale.

During kerogen agglomeration of the oil shale, the carbonate level increases along with the organic carbon concentration in the beneficiate. The presence of the carbonates can make oil shale more difficult to beneficiate. It is known that the kerogen-rich agglomerates produced during kerogen agglomeration retain or concentrate the calcium and magnesium carbonates minerals.

One way to avoid this problem is to remove the carbonates before physical separation. In Smith, J. W.; L. W. Higby "Preparation of Organic Concentrate from Green River Oil Shale," *Analytical Chemistry,* Vol. 32, No. 12, November 1960, the carbonate problem was address by removing the carbonates prior to physical separation by first contacting the oil shale with a 5 percent acetic acid solution. One difference between the method disclosed in the Smith reference and the instant invention is in the Smith method the oil shale is acid-treated prior to physical separation. In the instant invention, the shale is acid-treated after kerogen agglomeration. Another way of describing this difference is, in the Smith reference, the acid solution is contacted with raw oil shale particles having a kerogen concentration of about 6–30 weight percent whereas, in the instant invention, an acid solution is contacted with a kerogen-rich oil shale agglomerate. This agglomerate has a kerogen concentration of about double that of raw oil shale particles (the exact kerogen concentration of kerogen-rich oil shale agglomerates will depend on the kerogen weight percent of the raw oil shale, the mineral composition of the raw oil shale, and the type of process used to agglomerate the kerogen contained within the oil shale). Although the Smith method may be useful for obtaining kerogen for analytical studies, it would not be practical for commercial applications because of the cost of using a large amount of acid.

In U.S. Pat. No. 4,584,088, there is disclosed acid-treating a shale that has previously been treated chemically to aid in beneficiation. In this method, raw oil shale is first contacted with an aqueous caustic solution to produce a shale product of substantially transformed mineral content. Then the shale product is separated. Next the separated shale product is acid-treated treated. This method acid treats shale that has already been chemically beneficiated. One difference between this method and the instant invention is the instant invention acid treats physically beneficiated shale, whereas the method disclosed in U.S. Pat. No. 4,584,088 acid-treats chemically beneficiated shale.

There is a need for a viable, cost effective process for removing carbonates from kerogen-agglomerated oil shale.

SUMMARY OF THE INVENTION

In its broadest aspect, the present invention comprises kerogen-agglomerating the oil shale, separating out the kerogen-rich agglomerates, and acid-treating the kerogen-rich agglomerates. The present invention is a method of upgrading kerogen-agglomerated shale wherein the first step comprises contacting the oil shale with a two-phase mixture comprising an added organic liquid and water to form kerogen-rich agglomerates and mineral-rich particles. Next, the kerogen-rich agglomerates are separated from the mineral-rich particles. Finally, the kerogen-rich agglomerates are contacted with an acid-containing solution to form acid-treated, kerogen-rich agglomerates.

In one embodiment, the present invention comprises kerogen-agglomerating the oil shale, separating out the kerogen-rich agglomerates, acid-treating the kerogen-rich agglomerates, and reagglomerating the acid-treated, kerogen-rich agglomerates. This embodiment comprises contacting oil shale with a two-phase mixture comprising an added organic liquid and water to form kerogen-rich agglomerates and mineral-rich particles, separating the kerogen-rich agglomerates from the mineral-rich particles, contacting the kerogen-rich agglomerates with an acid-containing solution to form acid-treated, kerogen-rich agglomerates, and contacting the acid-treated, kerogen-rich agglomerates in a two-phase mixture comprising an added organic liquid and water.

In a further embodiment, the present invention comprises kerogen-agglomerating the oil shale, separating out the kerogen-rich agglomerates, and acid-treating and reagglomerating the kerogen-rich agglomerates simultaneously. This embodiment comprises the steps of comminuting raw oil shale in a two-phase liquid comprising an added organic liquid having a boiling point of about 100–1300 deg. F and water to form kerogen-rich agglomerates and mineral-rich particles, separating the kerogen-rich agglomerates from the mineral-rich particles in a screen having a size that prevents passage of the kerogen-rich particles and allows passage of the mineral-rich particles, and comminuting the kerogen-rich agglomerates in a two-phase liquid comprising an organic liquid having a boiling point of about 100–1300 deg. F. and an acid-containing solution comprising sulfurous acid to form acid-treated, kerogen-rich agglomerates and mineral rich particles.

In a further embodiment, the present invention comprises kerogen-agglomerating and acid-treating the oil shale simultaneously, and separating out the acid-treated, kerogen-rich agglomerates. The first step is to comminute the oil shale in a two-phase liquid consisting essentially of an added hydrocarbon liquid having a boiling point of about 150–1300 deg. F. and an acid-containing solution comprising sulfurous acid to form acid-treated, kerogen-rich agglomerates and mineral-rich particles. The acid-treated, kerogen-rich agglomerates are then separated from the mineral-rich particles using a screen having a screen that prevents passage of the acid-treated, kerogen-rich agglomerates but allows passage of the mineral-rich particles.

DESCRIPTION OF THE PREFERRED EMBODIMENTS

The starting material for the present invention is raw oil shale which has been mined using conventional techniques. A shale suitable for use in this invention can be characterized as having the following make up: about 6–30 weight percent kerogen, 40–50 weight percent silicates and clays, 22 to 42 weight percent carbonates, 0–10 weight percent dawsonites, and 0–12 weight percent nacholites. Mineralogy can have an effect on kerogen agglomeration. For example, shales abundant in silicates, zeolites, clays and dawsonites are generally easier to beneficiate by kerogen agglomeration than shales with an abundance of siderite, pyrite, ankerite, dolomite, and calcite. Shale grade can also have an effect on kerogen agglomeration. For example, in Mahogany shale, percent mineral rejection and percent product improvement decrease with increasing shale grade.

After mining the oil shale, the oil shale can be coarsely comminuted, finely comminuted, or any combination thereof to assist in liberating kerogen from the mineral rock. Coarsely comminuting the oil shale can be defined as reducing the size of the mined oil shale to a top size of greater than about ¼ in. Examples of equipment suitable for use in coarse comminution include semi-autogenous (SAG) mills, hammer mills, vibratory crushers, and cage mills, preferably SAG mills. A ball charge suitable for use in the SAG mill ranges from about 6–14 volume percent. The exact size of the mill will depend upon the desired throughput. In some cases, a plurality of mills in parallel may be required. The comminution scheme can be closed loop or open loop, preferably closed loop wherein a sieve is used for separation. The power input required can depend upon the type of oil shale used and the desired top size. For example, a 22 gal/ton Mahogany shale mined in tract c-a required 8 Kw-hr/ton to comminute from about 8 in top size to about 0.374 in. top size using a SAG mill and a 10 volume percent ball size. Finely comminuting the shale can be defined as reducing the size of the oil shale to top size of about ¼ in. to 0.003 in. Equipment suitable for use in finely comminuting the shale includes ball mills, tower mills, vibratory mills, and stirred ball mills. The preferred mill is a ball mill. A ball charge suitable for use in this mill ranges from about 35–65 volume percent. The exact size of the mill will depend upon the desired throughput. The comminution scheme can be closed loop or open loop, preferably closed loop.

After comminution, kerogen agglomeration is the next step. Kerogen agglomeration is based on the difference in surface properties between kerogen and minerals. Kerogen agglomeration comprises mixing oil shale particles with a two phase liquid mixture of organic liquid and water to form kerogen-rich particles and mineral-rich particles. Kerogen-rich particles tend to agglomerate forming an aggregate of particles clustered into approximately a spherical shape (kerogen-rich agglomerates). Mineral-rich particles do not agglomerate, but tend to form a dispersion in the aqueous phase.

In the kerogen agglomeration step of the present invention, the oil shale particles are contacted with an added organic liquid and water. The term "contact" is defined as coming together and touching, comminuting, or any combination thereof. In a preferred embodiment, the kerogen agglomeration step includes comminuting the oil shale particles in the organic liquid and water. This results in a better separation of the kerogen rich agglomerates and the mineral-rich particles. Comminution can be accomplished with a ball mill or a stirred ball mill. The comminution scheme can be open or closed, preferably open. The power input required to properly comminute the shale during kerogen agglomeration ranges from about 1–50 Kw-hr/ton, preferably 1–25 Kw-hr/ton. The organic liquid is not intended to be kerogen liberated from the oil shale itself, but rather is intended to be organic liquid that is added to this liberated kerogen. The organic liquid can be defined as a hydrocarbon liquid with a boiling point from about 150–1300 deg. F., preferably about 150–500 deg. F. Examples of such liquids include shale oils and petroleum fractions. In the event that the hydrocarbon liquid is shale oil, the shale oil can be a derivative of oil shale previously beneficiated using the present invention. The water can be fresh water or salt water. A suitable organic liquid to shale ratio for the present invention can be about 0.1 to 1.0. A suitable organic liquid to water ratio can be about 0.3 to 1.3, preferably about 0.44. A suitable amount of oil shale solids in the kerogen agglomeration step of the present invention can be about 25 to 75 weight percent, preferably about 53 percent. A suitable minimum agglomerate size for the present invention can be about 0.0117 in. (48 mesh) to 0.0015 in. (400 mesh).

If too much organic liquid is added in the shale, unstable agglomerates can be formed resulting in poor separation of the kerogen-rich agglomerates and the mineral-rich particles. Poor separation can also result from adding too little water because there would not be enough medium for rejecting the fines. Too little organic liquid added in the shale can result in not enough agglomerates being formed. Too much water can result in comminution inefficiencies.

After kerogen agglomeration, the kerogen-rich agglomerates and the mineral-rich particles are separated. Means suitable for use in separating out these agglomerates include screens, cyclones, and floatation equipment. The use of at least one screen is preferred. The size of the screen should be such that it prevents the passage of the large kerogen-rich agglomerates while it allows for the passage of the small mineral-rich agglomerates that are dispersed in the phase. A suitable screen sizes range from 0.0117 in. (48 mesh) to 0.0015 in. (400 mesh).

The final step in the present invention is to contact the beneficiate produced in the separation step with an acid-containing solution. The acid-containing solution comprises any acid or combination of acids that form soluble metallic salts, for example, sulfurous acid, hydrochloric acid and nitric acid. A suitable pH for this acid solution can be less than about 7, preferably less than about 3. Carbonates contained within the beneficiate react with the acid-containing solution to form acid sulfites which can be removed from the kerogen-rich agglomerates. A suitable acid solution/carbonate ratio can be about 0.3–1.5.

The acid treatment process can be illustrated by the following reaction: ((d)=dissolved, (s)=solid, (g)=gas)

(1) Shale kerogen+$CaCO_3$(s)+$CaMg(CO_3)_2$(s)+-$3SO_2$(d)+$H_2O$→Shale kerogen+$CaSO_3$(d)+Mg-($SO_3$)(d)+$H_2O$+$3CO_2$(d)

The acid can be regenerated via the following reactions:

(2) Recovery of Excess $SO_2$ and Precipitation of Sulfites:

$$SO_2(d) + CaSO_3(d) + MgSO_3(d) + H_2O \xrightarrow{heat} SO_2(g) + CaSO_3(s) + MgSO_3(s) + H_2O$$

(3) Re-formation of carbonates: $N(EtOH)_3$ is an amine, and N(EtOH) . . . $SO_2$ is a complex of an amine and $SO_2$:

$$CaSO_3(d)+MgSO_3(d)+N(EtOH)_3CO_2(d)+H_2O \rightarrow CACO_3(s)+MgCO_3(s)+N(EtOH)_3 \ldots SO_2+H_2O$$

(4) Recovery of $SO_2$ $$N(EtOH)_3 \ldots SO_2 \xrightarrow{heat} SO_2(g)\uparrow + N(EtOH)_3$$

The acid solution can be contacted with the agglomerated kerogen in at least one mix tank, preferably a plurality of tanks in series. The resulting acid-treated, kerogen-rich agglomerates can then be sent to a retort for kerogen conversion and the acid can be recovered.

In one embodiment of the present invention, the kerogen agglomeration step and the acid treatment step are combined, preferably in a single vessel. In this embodiment, the oil shale is comminuted in a two-phase mixture consisting essentially of an organic liquid and an acid-containing solution to form acid-treated, kerogen-rich agglomerates and mineral-rich particles. Comminution can be accomplished with a SAG mill, ball mill or a stirred ball mill. The comminution scheme can be open or closed, preferably open. The power input required to properly comminute the oil shale during kerogen agglomeration can be from about 1–50 Kw-hr/ton, preferably 1–25 Kw-hr/ton. The organic liquid can be defined as a hydrocarbon liquid with a boiling point from about 150–1300 deg. F., preferably 150–500 deg. F. Examples of such liquids include shale oils and petroleum fractions. The acid-containing solution can comprise water and any acid that forms a soluble metallic salt. Examples of acids suitable for use in this invention include sulfurous acid, hydrochloric acid and nitric acid. A suitable pH for this solution can be less than about 7, preferably less than about 3. A suitable organic liquid to oil shale ratio can be about 0.1–1.0. A suitable organic liquid to acid-containing solution ratio can be about 0.3–1.3. A suitable amount of solids in the kerogen agglomeration step can be about 25–75 weight percent. A suitable minimum size for the agglomerates can be about 0.0117 in. (48 mesh) to 0.0015 in. (400 mesh).

Thus far the invention has been described in terms of a single agglomeration step process. In one embodiment of the present invention, the kerogen contained in the oil shale is agglomerated at least twice, once before acid treatment and again after acid treatment. This embodiment is applicable whether the acid treatment step occurs subsequent to the kerogen agglomeration step or at the same time as the kerogen agglomeration step. By reagglomerating the acid-treated, kerogen-rich agglomerates, carbonates which had interfered with the concentration of kerogen in the first agglomeration are eliminated prior to the second agglomeration. As a result, the second agglomeration is more effective than the first in concentrating the kerogen.

This reagglomeration process comprises contacting the acid-treated, kerogen-rich agglomerates with an added organic liquid (assuming the organic liquid was removed prior to acid treatment) and water. Reagglomeration can include comminution using the same types of equipment disclosed for use in the kerogen agglomeration that occurred prior to acid treatment. The types of organic liquids suitable for use in reagglomeration are the same as those disclosed for the kerogen agglomeration that occurred prior to acid treatment. The amounts of organic liquid and water suitable for use in reagglomeration are the same as those disclosed for the kerogen agglomeration that occurred prior to acid treatment. In one embodiment of this reagglomeration process, a substantial amount of the excess organic liquid can be removed prior to acid treatment and a substantial amount of the water can be removed prior to reagglomeration.

EXAMPLE 1

The purpose of this experiment was to evaluate acid treatment of oil shale after it has been precomminuted in a dry environment and kerogen agglomerated.

The comminution equipment consisted of an 8 in. I.D.×10 in. long steel jar mill. It was operated at 71.3 rpm 76.0 percent theoretical critical speed (TCS) for a 120 min time duration. The comminution media was 1 in. diameter steel balls.

The feed material was 22 gal/ton raw oil shale. The shale was essentially 99 percent minus 0.047 in. (14 mesh), with approximately 15 percent minus 0.0083 in. (65 mesh), the feed 80 percent passing point corresponded to approximately 0.035 in.

In the first stage, 1952 g of the feed material were mixed with 35 lbs of the grinding media and comminuted in the jar mill for 120 min. The product from this first stage of milling was 80 percent minus 0.003 in.

In the second stage, 1000 g of the product from the first stage were blended with 500 g of octane to form a thick, mud-like consistency material. This mixture and 2000 g of water were charged into the jar mill and run for 60 min.

The organics formed into black nodules which were separated, weighed, and dried. The separation efficiency was 41. Separation efficiency is defined as the difference between the recovery of organics in the product stream and the recovery of inorganics in the product stream. The total power consumption was 73 Kw-hr/ton, 37 Kw-hr/ton in the first stage and 36 Kw-hr/ton in the second stage.

These organic black nodules, herein referred to as kerogen-rich agglomerates, were substantially concentrated in kerogen. Organic liquid was removed from the kerogen-rich agglomerates by evaporation and the kerogen-rich solids were placed in a beaker.

An excess of a 1 molar sulfurous acid was added to the agglomerates, and the acid/agglomerate mixture was vigorously stirred. When foaming stopped, the acid was removed and another aliquot of the acid was added to the beaker. Following stirring and foaming, the process was repeated once again with the final aliquot of the acid. The agglomerates were then filtered and water-washed. Table 1 shows that by acid-treating oil shale that has been dry ground and kerogen agglomerated, the shale grade can be from 40 gal/ton to 64 gal/ton.

EXAMPLE 2

The purpose of this example was to evaluate acid treatment of an oil shale that has been precomminuted in an organic liquid and kerogen agglomerated.

The comminution equipment used in this example was the same as the comminution equipment used in Example 1.

The feed material was a blend of different shales having a grade of 22 gal/ton. The shale was essentially 97 percent minus 0.047 in. (14 mesh), with only approximately30 percent minus 0.0083 in. (65 mesh). The feed 80 percent passing point corresponds to approximately 0.035 in.

In the first stage, 1952 g of this feed material were mixed with 35 lbs of the comminution media and 1952 ml of octane, and comminuted for 60 min.

In the second stage, 1000 g of the product from the first stage were blended with 500 ml octane to form a thick mud-like consistency. This material and 2000 g of water were charged into the jar mill and run for 60 min.

The organics formed into black nodules which were separated, weighed, and dried. The separation efficiency was 40. The total power consumption was 55 Kw-hr/ton, 18 Kw-hr/ton in the first stage and 36 Kw-hr/ton in the second stage.

These organic black nodules, herein referred to as kerogen-rich agglomerates, were substantially concentrated with kerogen. Organic liquid was removed from these kerogen-rich agglomerates by evaporation and the kerogen-rich solids were placed in a beaker. After placing these kerogen-rich agglomerates in a beaker, an excess of the 1 molar sulfurous acid was added to the shale, and the acid shale mixture was vigorously stirred. When foaming stopped, the acid was removed and another aliquot of the acid was added. Following stirring and foaming, the process was repeated once again with a final amount of the acid. Then the shale was filtered and water-washed. Table 1 shows that an oil shale that has been preground in an organic liquid and kerogen agglomerated can be upgraded from 38 gal/ton to 63 gal/ton.

EXAMPLE 3

Shale having an average grade of 20 gal/ton was wetted with decane and ground in an open circuit continuous ball mill with a water-to-shale ratio of 3.4. The agglomerates, having a size greater than 0.0117 inches (48 mesh), were put in the beaker. Excess 1 normal sulfurous acid was added to the agglomerate. Then the water solution was removed by filtration. The agglomerates were dried and analyzed for total and carbonate carbon. The results are shown in Table 1.

TABLE 1

ACID-TREATING TEST RESULTS

| Example | Solvent Removal Prior To Acid Treat | % Organic Carbon Feed (GPT) | % Organic Carbon Product (GPT) | % Carbonate Carbon in Feed | % Carbonate Carbon in Product | Inorganic Removed | Organic Recovery |
|---|---|---|---|---|---|---|---|
| 1 | Yes | 19.09 (40) | 30.1 (64) | 4.8 | 0.43 | 37.8% | 100% |
| 2 | Yes | 18.08 (38) | 29.4 (63) | 5.2 | 0.73 | 41.3% | 96% |
| 3 | No | 18.81 (40) | 30.19 (66) | 4.5 | 0.22 | 37.7% | 100% |

That which is claimed is:

1. A method of upgrading kerogen-agglomerated oil shale, comprising the steps of:
   (a) contacting oil shale with a two-phase mixture comprising an added organic liquid and water to form kerogen-rich agglomerates and mineral-rich particles;
   (b) separating the kerogen-rich agglomerates from the mineral-rich particles and water utilizing at least one screen, said screen having a size that prevents passage of the kerogen-rich agglomerates and allows for passage of the mineral-rich particles and water, thereby producing solid, kerogen-rich agglomerates; and
   (c) contacting the solid, kerogen-rich agglomerates with an acid-containing solution having a pH of less than about 3 to form acid-treated, kerogen-rich agglomerates.

2. A method of claim 1 wherein the oil shale comprises raw oil shale.

3. A method of claim 1 wherein prior to step (a) a substantial portion of the oil shale is comminuted to a top size of about 1.0–0.003 in.

4. A method of claim 1 wherein the organic liquid comprises a hydrocarbon liquid having a boiling point from about 150–1300 deg. F.

5. A method of claim 1 wherein the organic liquid comprises a petroleum fraction.

6. A method of claim 1 wherein the organic liquid comprises shale oil.

7. A method of claim 6 wherein in step (a) there is an organic liquid to oil shale ratio of about 0.1–1.

8. A method of claim 6 wherein in step (a) there is an organic liquid to water ratio of about 0.3–1.3.

9. A method of claim 1 wherein in step (a) there is a power input of about 1–50 Kw-hr/ton.

10. A method of claim 1 wherein in step (b) the kerogen-rich agglomerates are separated from the mineral-rich particles using at least one screen having a size of about 0.0117–0.0015 in.

11. A method of claim 1 wherein the acid-containing solution comprises any acid that forms a soluble metallic salt.

12. A method of claim 11 wherein the acid is sulfurous acid.

13. A method of claim 11 wherein the acid-containing solution has a pH of less than about 3.

14. A method of claim 1 further comprising removing excess organic liquid from the kerogen-rich agglomerates after step (b) and before step (c).

15. A method of claim 1 further comprising step (d), step (d) comprising contacting the acid-treated, kerogen-rich agglomerates with a two-phase mixture comprising an added organic liquid and water.

16. A method of claim 15 wherein a substantial amount of excess organic liquid is removed prior to step (c) and a substantial amount of the water is removed prior to step (d).

17. A method of claim 15 wherein the acid-treated, kerogen-rich agglomerates are comminuted in an added hydrocarbon liquid having a boiling point form about 150–1300 deg. F. and water.

18. A method of claim 17 wherein in step (d) the hydrocarbon liquid comprises a petroleum fraction.

19. A method of claim 17 wherein in step (d) the hydrocarbon liquid comprises shale oil.

20. A method of claim 15 wherein in step (d) there is a hydrocarbon liquid to oil shale ratio of about 0.1–1.0.

21. A method of claim 15 wherein in step (d) there is a hydrocarbon liquid to water ratio of about 0.3–1.3.

22. A method of claim 15 wherein in step (d) there is a power input of about 1–50 Kw-hr/ton of shale.

23. A method of upgrading kerogen-agglomerated oil shale, comprising the steps of:

(a) comminuting raw oil shale with a two phase liquid consisting essentially of an added hydrocarbon liquid having a boiling point from about 150–1300 deg. F. and water to form kerogen-rich agglomerates and mineral-rich particles;

separating the kerogen-rich agglomerates from the mineral-rich particles and water utilizing at least one screen, said screen having a size that prevents passage of the kerogen-rich agglomerates and allows for passage of the mineral-rich particles and water, thereby producing solid, kerogen-rich agglomerates; and (c) contacting the solid, kerogen-rich agglomerates with an acid-containing solution comprising sulfurous acid to form acid-treated, kerogen-rich agglomerates.

24. A method of claim 23 wherein prior to step (a) a substantial portion of the oil shale is comminuted to a top size of about 1–0.003 in.

25. A method of claim 23 wherein the hydrocarbon liquid comprises a petroleum fraction.

26. A method of claim 23 wherein the hydrocarbon liquid comprises shale oil.

27. A method of claim 23 wherein in step (a) there is a hydrocarbon liquid to shale ratio of about 0.1–1.

28. A method of claim 23 wherein in step (a) there is a hydrocarbon liquid to water ratio of about 0.3–1.3.

29. A method of claim 23 wherein in step (a) there is a power input of about 1–50 Kw-hr/ton of shale.

30. A method of claim 23 wherein in step (b) the size of the screen is about 0.0117–0.0015 in.

31. A method of claim 23 wherein the acid-containing solution has a pH of less than 3.

32. A method of claim 23 wherein the acid-containing solution is present at a acid-containing solution to carbonate ratio of about 0.3–1.5.

33. A method of upgrading kerogen-rich agglomerates, comprising the steps of:

(a) comminuting raw oil shale in an added shale oil and water at a power input of about 1–50 Kw-hr/ton of shale to form kerogen-rich agglomerates and mineral-rich particles, the shale being present at a shale oil to oil shale ratio of about 0.1–1.0, the water being present at a shale oil to water ratio of about 0.3–1.3; and (b) separating the kerogen-rich agglomerates from the mineral-rich particles and water utilizing a screen having a screen size of about 0.0117 to 0.0015 in, thereby producing solid, kerogen-rich agglomerates; and (c) contacting the solid, kerogen-rich agglomerates with an acid-containing solution consisting essentially of sulfurous acid to form acid-treated, kerogen-rich agglomerates, said acid-containing solution having a pH of less than about 3 and being present at an acid-containing solution to carbonate ratio of 0.3–1.5.

34. A method of upgrading kerogen-rich agglomerates, comprising the steps of:

(a) comminuting the raw oil shale in a two-phase liquid comprising an added organic liquid having a boiling point of about 100–1300 deg. F. and water to form kerogen-rich agglomerates and mineral-rich particles;

(b) separating the kerogen-rich agglomerates from the mineral-rich particles and water using at least one screen, said screen having a size that prevents passage of the kerogen-rich agglomerates and allows for passage of the mineral-rich particles and water, thereby producing solid, kerogen-rich agglomerates; and (c) comminuting the solid, kerogen-rich agglomerates in a two-phase liquid comprising an added organic liquid having a boiling point of about 100–1300 deg. F. and an acid-containing solution comprising sulfurous acid to form acid-treated, kerogen-rich agglomerates and mineral-rich particles.

35. A method of upgrading kerogen-rich agglomerates, comprising the steps of:

(a) comminuting oil shale in a two-phase liquid consisting essentially of an added hydrocarbon liquid having a boiling point of about 150–1300 deg. F. and an acid-containing solution comprising sulfurous acid to form acid-treated, kerogen-rich agglomerates and mineral-rich particles; and (b) separating the acid-treated, kerogen-rich agglomerates and the mineral-rich particles using at least one screen having a size that prevents passage of the acid-treated, kerogen-rich agglomerates but allows passage of the mineral-rich particles.

36. A method of claim 35 wherein the hydrocarbon liquid comprises a petroleum fraction.

37. A method of claim 35 wherein the hydrocarbon liquid comprises a shale oil.

38. A method of claim 35 wherein there is a hydrocarbon liquid to oil shale ratio of about 0.1–1.0.

39. A method of claim 35 wherein there is a hydrocarbon liquid to acid-containing solution ratio of about 0.3–1.3.

40. A method of claim 35 wherein there is an power input of about 1–50 Kw-hr/ton.

41. A method of claim 35 wherein the acid-containing solution has a pH of less than about 3.

42. A method of upgrading kerogen-agglomerated oil shale, comprising the steps of;

(a) comminuting raw oil shale in an added shale oil and an acid-containing solution consisting essentially of sulfurous acid at an power input of about 1–50 Kw-hr/ton to form acid-treated, kerogen-rich agglomerates and mineral-rich particles, the shale oil being present at a shale oil to oil shale ratio of about 0.1–1.0, the acid-containing solution being present at a shale oil to acid-containing solution ratio of about 0.3–1.3, the acid-containing solution having a pH of less than about 3; and (b) separating the acid-treated, kerogen-rich agglomerates from the mineral-rich particles using a screen having a size of about 0.0117–0.0015 in.

* * * * *